US006536847B2

(12) United States Patent
Clapham et al.

(10) Patent No.: US 6,536,847 B2
(45) Date of Patent: Mar. 25, 2003

(54) PICK BOX FOR HOUSING A MINERAL CUTTER PICK

(75) Inventors: William Stephen Clapham, Barnsley (GB); John Joseph Warren, Spotborough (GB); Gunter Dlugosch, Hamm (DE); Angelo Weigelt, Hamm (DE)

(73) Assignee: Hydra Mining Tools International LTD (GB)

( * ) Notice: Subject to any disclaimer, the term of this patent is extended or adjusted under 35 U.S.C. 154(b) by 0 days.

(21) Appl. No.: 09/902,382

(22) Filed: Jul. 10, 2001

(65) Prior Publication Data

US 2002/0053827 A1 May 9, 2002

(30) Foreign Application Priority Data

Jul. 18, 2000 (GB) ..... 0017470

(51) Int. Cl.[7] ..... E21C 35/187; E21C 35/22

(52) U.S. Cl. ..... 299/81.2; 299/81.1; 175/340; 175/424

(58) Field of Search ..... 299/102–107, 299/110–111, 81.1–81.3; 175/340, 393, 424

(56) References Cited

U.S. PATENT DOCUMENTS 4,705,321 A * 11/1987 Hedlund ..... 299/81.3

FOREIGN PATENT DOCUMENTS

| | | |
|---|---|---|
| DE | 3116569 | * 11/1982 |
| GB | 2135716 | 3/1983 |
| GB | 2144787 | 7/1984 |
| GB | 2273513 | 11/1993 |

* cited by examiner

*Primary Examiner*—David Bagnell
*Assistant Examiner*—Sunil Singh
(74) *Attorney, Agent, or Firm*—Trexler, Bushnell, Giangiorgi, Blackstone & Marr, Ltd.

(57) ABSTRACT

A "wet" pick box 1 comprises a body member 2, adapted in use to be welded to a rotary cutting head, whilst an aperture 5 is provided in the body member. Bores 15, 16 in the body member define an internal water course 6 connectable, at an inlet end 7, to a source of pressurised water, an aperture 8 in the body member is adapted to house a water discharge nozzle and is connected to an outlet end 9 of the watercourse 6. A tapped hole 10 intersects the bores 15 and 16 and a member 11A or 11B is insertable into, and removable from, the hole 10. A rotary mineral cutting head can be provided to which a plurality of such pick boxes are welded.

10 Claims, 2 Drawing Sheets

PICK BOX FOR HOUSING A MINERAL CUTTER PICK

FIELD OF THE INVENTION

This invention relates to a pick box for releasably housing a cutter pick, with the box adapted in use, to be mounted on a rotary cutting head of a shearer drum for mineral winning operations, or of a rock culling head for underground roadway or tunnel driving operations, or also for mineral winning, or, for surface use, of a road planing machine as part of highway maintenance.

BACKGROUND OF THE INVENTION

All boxes, whether produced as steel castings or forgings, have an aperture to receive the shank of a cutter pick, the aperture diminishing the material and hence strength of the box and thus unavoidably creating an area of weakness, and hence breakage in extreme cutting conditions eg when encountering a band of hard rock or when inadvertently striking a metal object such as a roof beam, strata anchor etc.

Furthermore, when considering round pick shanks and hence round box apertures, the setting angle applied to the box on the rotary cutting head to give the correct cutting attitude of the pick, adds to the vulnerability of the box. The introduction of a sleeve between the pick shanks and the bore aperture reduces further the section of the box material remaining. In addition, current developments in box design include "wet" systems, fed by internal watercourse bores; which bores again create structural weakness to the box.

Apart from wear, "wet" boxes are prone, in general to two failings:

1. loss of system pressure when boxes are broken below their water carrying bores, and
2. internal blockage from water home debris.

Whilst a rotary cutting head or shearer drum may have 50 or more pick boxes, the breakage of one or two boxes will not greatly impair the cutting efficiency and the practice is to continue the use of a rotary member with broken boxes until say a scheduled maintenance period is reached, because a broken box requires the broken box(es) to be burnt off, and a replacement box to be welded on, and as such operations are not allowed by law in UK coal, mines the rotary member must be removed from the mining or tunnelling machine and transported either to the surface or to a safe area, for welding.

Apart from the above problem, and as indicated previously a broken box exposes a water bore, so that, instead of the water flow being throttled by a relatively small diameter spray nozzle or discharge of a spray at the required area, large quantities of water are wasted by uncontrolled emission from an exposed bore, resulting in diminished, or ineffective flow to the remaining spray nozzles, as well as inconvenient deposit of water in the mining etc area.

OBJECT OF THE PRESENT INVENTION

A basic object of the present invention is the provision of an improved "wet" pick box.

Summary of a First Aspect of the Invention

According to the present invention, there is provided a "wet" pick box for releasably housing a shank of a mineral cutter pick, the box comprising:

(i) a body member, adapted in use to be secured to a rotary member, aid having a front end and a rear end (having regard to the directions of rotation of the rotary member, in use);

(ii) an aperture in the body member corresponding cross-section to that of the sleeve or of a shank of a cutter pick intended, in use, to be carried by the box;

(iii) at least one bore in the body member defining an internal water course connectable, at an inlet end, to a source of pressurised water;

(iv) a water discharge nozzle also housed in an aperture in the body member and connected to an outlet end of the watercourse;

(v) a hole intersecting the bore towards tie rear end of the box, and (vi) a member insertable into, and removable from the hole and, in one embodiment, to permit water flow, and in another embodiment blanking-off the bore to prevent water flow.

Advantages of the Invention

By the provision of the alternative insertable members, one member, for normal operation with a non-broken box, to permit water flow and may carry a water filter eg a gauze, to prevent debris entrained in the water supply reaching the spray nozzle and blocking same.

Importantly, if a box breakage should occur, then the flow permitting member is removed and replaced by a blanking-off member, which blocks water flow aid hence prevents uncontrolled emission or discharge of water from a bore exposed by the breakage, thus maintaining the water pressure for the remainder of the spray nozzles.

Preferred or Optional Features of the Invention

The hole intersecting the bore is a tapped hole, with the insertable member having an external thread.

The insertable member in one embodiment carries a filter through which the water must flow to reach the spray nozzle.

The filter is a thimble shaped metal gauze located in a receiving recess of the insertable member.

The insertable member, of any form carries at least one scaling ring.

The aperture in the body member is hexagonal.

A tapped hole is provided at or towards a front end of the box, to receive a water spray nozzle.

The internal watercourse is defined by at least two linear bores intersecting at a side face of the box at a side chamber which is closed-off by a cover plate, which is removable to expose ends of the intersecting bores, whereby a rod may be inserted to clear debris blocking the bore(s).

Summary of a Second Aspect of the Invention

According to a second aspect of the invention, there is provided a rotary, mineral cutting head to which a plurality of pick boxes in accordance with the first aspect, are welded.

The invention will now be described in greater detail, by way of example, with reference to the accompanying drawings, in which.

Figure 2:
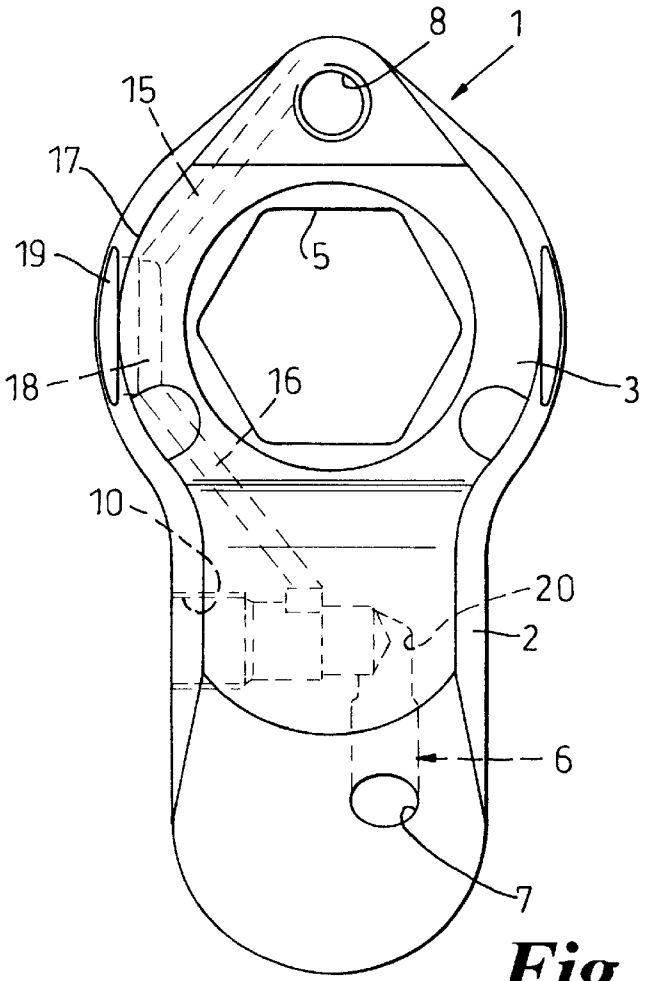
FIG. 2 is an end elevation of FIG. 1 in the direction of arrow A.
Figure 1:
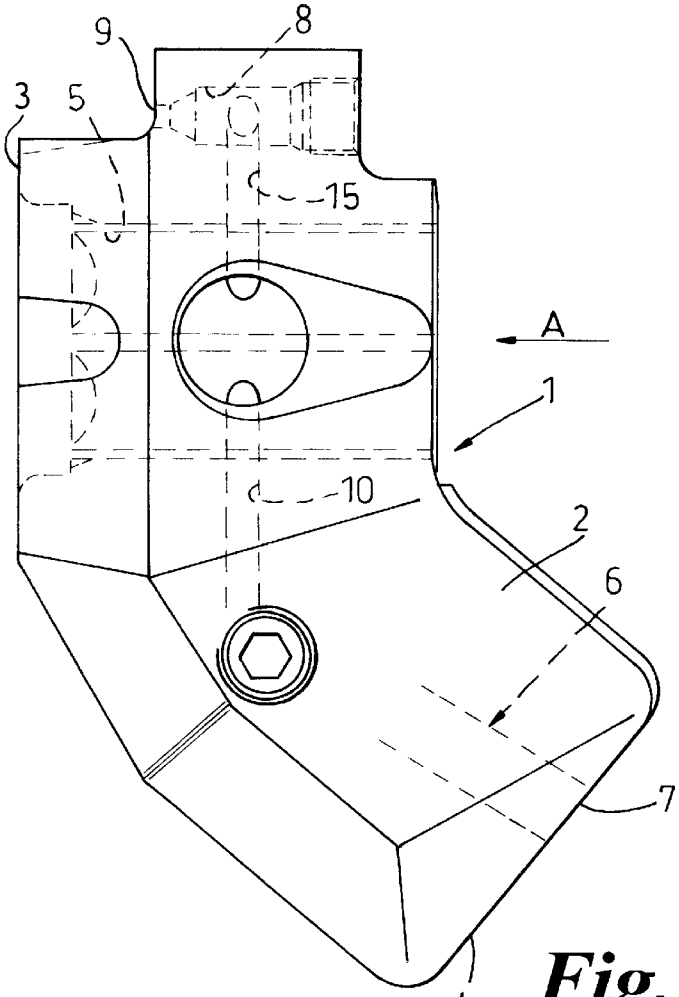
FIG. 1 is a side elevation of a pick box in accordance with the invention.
Figure 3:
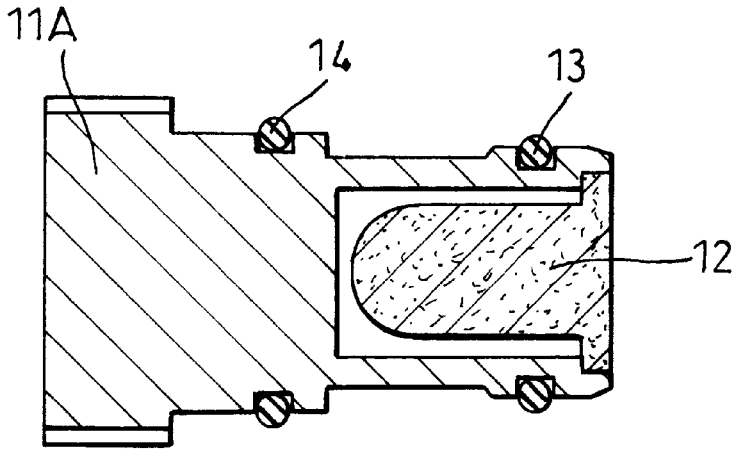
FIGS. 3 and 4 show two alternative plugs to be fitted into the pick box of FIGS. 1 and 2.
Figure 4:
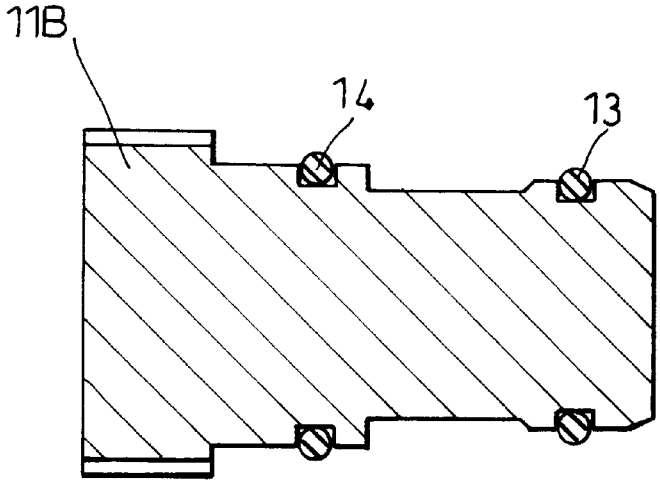

A "wet" pick box 1 comprises a body member 2, adapted in use to be welded to a rotary cutting head, and having a front end 3 and a rear end 4 (having regard to the directions of rotation of the cutting head, in use). The body member 2 is provided with a hexagonal aperture 5 to receive a receive or of a shank of a cutter pick intended, in use, to be carried by, and releasably retained in, the box 2. Multiple bores 15, 16, 20 in the body member define an internal water course 6 connectable, at an inlet end 7, to a source of pressurised water, whilst a water discharge/spray nozzle (not shown) is also housed in an aperture 8 in the body member and connected to an outlet end 9 of the watercourse. A tapped hole 10 intersects the bore 16 towards the rear end 4 of the pick box 1, and a screw threaded plug member 11A is insertable into, and removable from the hole 10 to permit water flow, or alternatively plug 11B capable, of blanking-off the bore 20 to prevent water flow. To guard against contaminated water being supplied and contaminants eventually blocking the spray nozzle, the plug 11A carries a metal gauze filter 12 through which the water must flow to reach the spray nozzle whilst both plugs 11A and 11B carry deformable scaling rings 13, 14.

The two linear bores 15, 16 intersect at a side face 17 of the box 1 at a side chamber 18 which is closed-off by a cover plate 19, which is removable to expose ends of the intersecting bores, whereby a rod may be inserted to clear any debris blocking the bores 15 or 16.

What is claimed is:

1. A "wet" pick box for releasably housing a shank of a mineral cutter pick, the box comprising:

(i) a body member, adapted in use to be secured to a rotary member, and having a front end and a rear end;

(ii) a first aperture provided in said body member and corresponding in cross-section to that of a sleeve or of a shank of a cutter pick intended, in use, to be inserted into said aperture;

(iii) an internal water course provided in said body member and defined by at least one bore, said water course being connectable, at an inlet end thereof, to a source of pressurised water;

(iv) a second aperture provided in said body member and adapted to house a water spray nozzle with said second aperture connected to an outlet end of said water course;

(v) a hole intersecting said bore towards said rear end of said body member, and (vi) said hole accommodating optionally either a first member capable of permitting water flow to said spray nozzle for normal operation, or, in circumstances of a box becoming broken in use, a second member capable of blanking-off the bore and preventing water flow.

2. A pick box as claimed in claim 1, wherein said hole intersecting said bore is a tapped hole, with each of said optional insertable members having an external thread.

3. A pick box as claimed in claim 1, wherein said first insertable member carries a filter through which the water must flow to reach said spray nozzle.

4. A pick box as claimed in claim 3, wherein said filter is a thimble shaped metal gauze located in a receiving recess of said insertable member.

5. A pick box as claimed in claim 1, wherein said second insertable member constitutes a blanking-off plug to prevent water flow.

6. A pick box as claimed in claim 1, wherein at least one scaling ring is carried by each of said first and second insertable members.

7. A pick box as claimed in claim 1, wherein said first aperture in said body member is hexagonal.

8. A pick box as claimed in claim 1, wherein said second aperture is a tapped hole.

9. A pick box as claimed in claim 1, wherein at least two linear bores define said internal water course, said two linear bores intersecting at a side face of said box at a side chamber of said box which side chamber is closed-off by a cover plate, which cover plate is removable to expose ends of said intersecting bores, whereby a rod may be inserted to clear any debris blocking the bore(s).

10. A rotary, mineral cuffing head to which a plurality of pick boxes are welded, each pick box comprising:

(i) a body member, adapted in use to be secured to a rotary member, and having a front end and a rear end;

(ii) a first aperture provided in said body member and corresponding in cross-section to that of a sleeve or of a shank of a cutter pick intended, in use, to be inserted into said aperture;

(iii) an internal water course provided in said body member and defined by at least one bore, said water course being connectable, at an inlet end thereof, to a source of pressurised water;

(iv) a second aperture provided in said body member and adapted to house a water spray nozzle with said second aperture connected to an outlet end of said water course;

(v) a hole intersecting said bore towards said rear end of said body member, and (vi) said hole accommodating optionally either a first member capable of permitting water flow to said spray nozzle for normal operation, or, in circumstances of a box becoming broken in use, a second member capable of blanking-off the bore and preventing water flow.

* * * * *